US006067104A

United States Patent [19]

Taniguchi et al.

[11] Patent Number: 6,067,104

[45] **Date of Patent: *May 23, 2000**

[54] THERMAL PRINT HEAD, METHOD OF MANUFACTURING THE SAME AND METHOD OF ADJUSTING HEAT GENERATION THEREOF

[75] Inventors: Hideo Taniguchi; Yasuhisa Fujii, both of Kyoto, Japan

[73] Assignee: Rohm Co., Ltd., Kyoto, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/699,573

[22] Filed: Aug. 19, 1996

[30] Foreign Application Priority Data

Aug. 22, 1995 [JP] Japan ..... 7-213169
Aug. 25, 1995 [JP] Japan ..... 7-217065

[51] Int. Cl.[7] ..... B41J 2/335

[52] U.S. Cl. ..... 347/202; 347/204

[58] Field of Search ..... 347/200, 202, 347/203, 204, 205, 206, 208, 209, 62; 29/611

[56] References Cited

U.S. PATENT DOCUMENTS 4,532,530 7/1985 Hawkins ..... 347/62
4,935,752 6/1990 Hawkins ..... 347/62
5,055,859 10/1991 Wakabayashi et al. ..... 347/209
5,317,341 5/1994 Tatsumi ..... 347/200
5,483,736 1/1996 Ohnishi ..... 29/611
5,559,543 9/1996 Komuro ..... 347/62

FOREIGN PATENT DOCUMENTS 0 398 359 11/1990 European Pat. Off. .
5-14618 2/1993 Japan .
7-10601 2/1995 Japan .

*Primary Examiner*—N. Le
*Assistant Examiner*—Anh T. N. Vo
*Attorney, Agent, or Firm*—Nikaido Marmelstein Murray & Oram LLP

[57] ABSTRACT

A polycrystalline layer is formed on a surface of a substrate and metal electrode layers are formed thereon to be opposed to each other. The polycrystalline silicon layer includes an exposed region exposed from the metal electrode layers, and this exposed region includes low resistance regions extending under the metal electrode layers to be in a pair, and a high resistance region having a high sheet resistance defined between the low resistance regions. At least one of the low resistance regions is so trimmed as to adjust heat generation from the high resistance region.

8 Claims, 5 Drawing Sheets

FIG.9 PRIOR ART HEAT GENERATOR PART 20
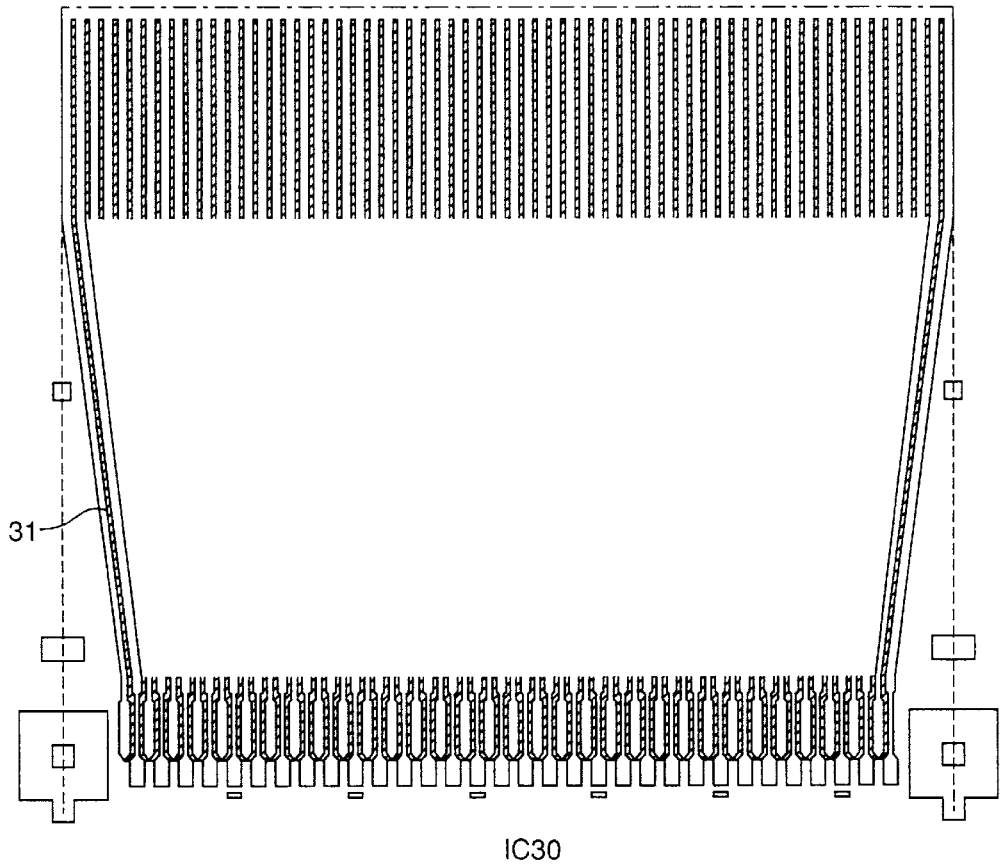
FIG.10 PRIOR ART
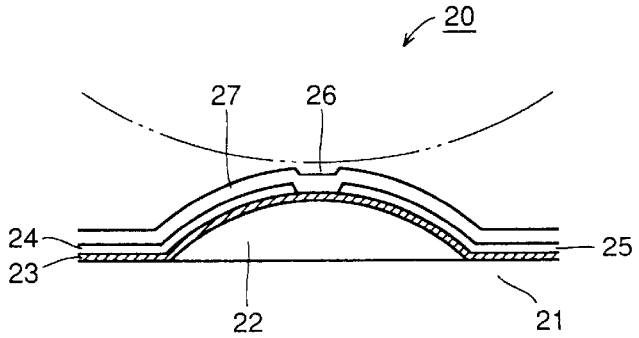

THERMAL PRINT HEAD, METHOD OF MANUFACTURING THE SAME AND METHOD OF ADJUSTING HEAT GENERATION THEREOF

BACKGROUND OF THE INVENTION

1. Field of the Invention

The present invention relates to a thermal print head, a method of manufacturing the same and a method of adjusting heat generation thereof. More specifically, the present invention relates to a thermal print head having a heat generation part consisting of a resistor which is prepared from polycrystalline silicon, a method of manufacturing the same and a method of adjusting heat generated from the heat generation part.

2. Description of the Background Art

FIG. 7 is a perspective view showing the overall appearance of a conventional thin film type thermal print head and FIG. 8 is a sectional view thereof, while FIG. 9 illustrates patterns connecting an IC and a heat generator part with each other and FIG. 10 is an enlarged sectional view showing the heat generator part.

Referring to FIGS. 7 and 8, a heat generator part 20 is provided on an end of an insulating substrate 21 along its longitudinal direction, while an IC 30 for driving the head is arranged on the other end. The heat generator part 20 is separated into respective dots. The heat generator part 20 and the IC 30 are electrically connected with each other by aluminum electrode patterns 31 every dot, as shown in FIG. 9. Illustration of the aluminum electrode patterns 31 is omitted in the blank part of FIG. 9.

The heat generator part 20 includes a glaze layer 22 which is formed on a surface of the insulating substrate 21 for serving as a heat storage layer as shown in FIG. 10, and a plurality of strip-shaped resistor layers 23 are formed on this glaze layer 22 in parallel with each other. These resistor layers 23 are provided thereon with a common electrode 24 and individual electrodes 25 consisting of metals, which are stacked and formed to be opposed to each other. A heat generation region 26 consisting of a resistor layer is provided between the common electrode 24 and the individual electrodes 25. The common electrode 24 is connected to an Ag common electrode 32 shown in FIG. 7, while the individual electrodes 25 are connected to the IC 30 through the aluminum electrode patterns 31 shown in FIG. 9. When a control signal is supplied to the IC 30, an electric signal is applied to the individual electrodes 25, so that the heat generator part 20 generates a heat signal for image formation by energization. A protective film 27 is formed on the heat generation region 26, the common electrode 24 and the individual electrodes 25 of the heat generator part 20, for covering and protecting the same.

When a printed medium is brought into contact with the heat generation region 26 and moved in the thermal print head, the heat signal must generally be transmitted from the heat generation region 26 to the printed medium which is in a state being pressed and moved in order to obtain an excellent printed image. Thus, adhesion between the heat generation region 26 and the printed medium is important. Under such circumstances, various structures of thermal print heads have been proposed in order to improve contactability of printed media with respect to heat generation regions.

For example, Japanese Patent Publication No. 7-10601 (1995) discloses a thermal print head in which common and individual electrodes are formed by metal wires of a multilayer structure thereby reducing the thicknesses of electrode parts adjacent to a heat generation region. In this thermal print head, a protective film once formed on the heat generation region is removed by etching in a constant amount from the heat generation region thereby attaining flatness of the protective film on this region, in order to improve the contact property of a printed medium with respect to the heat generation region.

Following the recent development of the semiconductor technique, on the other hand, there has also been proposed a thermal print head in which a heat generation resistor is prepared from polycrystalline silicon containing a constant amount of impurity. For example, Japanese Patent Publication No. 5-14618 (1993) discloses a thermal print head comprising a resistor layer consisting of polycrystalline silicon doped with an impurity element provided on a glaze layer which is formed on a ceramic substrate, and common and individual electrodes which are formed on the resistor layer to be opposed to each other.

The application field of the thermal print head is increasingly enlarged following development of the working technique, and a demand for application to a color printer capable of forming high-quality color images is particularly increased in recent years.

The so-called solid printing is relatively frequently employed in a head for such a color printer, due to its application. In the head for a color printer, therefore, a superior contact property of a printed medium with respect to a heat generation region is required as compared with a general head for monochromatic printing, while more sufficient electric energy must be supplied to common and individual electrodes. In the aforementioned head structure disclosed in Japanese Patent Publication No. 7-10601 (1995), however, the contact property with respect to the printed medium is improved by removing the protective film from the heat generation region by etching and attaining flatness of the protective film surface. Thus, an additional step for the etching is required and hence the steps are complicated, while the thickness of the protective film may be dispersed due to uneven etching.

In the thermal print head consisting of the resistor layer which is prepared from the polycrystalline silicon doped with an impurity described in Japanese Patent Publication No. 5-14618 (1993), on the other hand, portions of the heat generation region between the common and individual electrodes are still formed concave similarly to the structure shown in FIG. 10, and hence the printed medium cannot attain a sufficient contact property with respect to the heat generation region.

In the color printer, further, color irregularity may disadvantageously be conspicuous due to dispersion of heating values in the respective dots of the heat generator part in case of a high gradient of 256 gradations or the like, although such color irregularity is rather inconspicuous in case of 64 or 128 gradations, for example.

SUMMARY OF THE INVENTION

Accordingly, a principal object of the present invention is to provide a thermal print head improving a contact property of a printed medium with respect to a heat generation region while enabling supply of sufficient electric energy to the heat generation region, and a method of manufacturing the same.

Another object of the present invention is to provide a heat generation adjusting method which can homogeneously adjust heating values of respective dots.

In a thermal print head according to an aspect of the present invention, a polycrystalline silicon layer containing an impurity is formed on a surface of a substrate, and metal electrode layers are formed on the polycrystalline silicon layer to be opposed to each other, while the silicon layer includes an exposed region which is exposed from the metal electrode layers, and this exposed region includes low resistance regions extending under the metal electrode layers to be in a pair and a high resistance region having a high sheet resistance which is defined between the low resistance regions.

According to the present invention, therefore, the high resistance region for serving as a heat generation region is partially formed in the polycrystalline silicon layer between the opposite metal electrode layers, whereby a surface of a protective film provided on the high resistance region is not substantially irregularized but a printed medium can be brought into contact with the high resistance region in an excellent state. In this case, power is supplied to the high resistance region from the polycrystalline silicon layer which is adjacent to and integrated with the same through the low resistance regions.

In a more preferred embodiment of the present invention, the low resistance regions contain an impurity element, and the high resistance region contains the impurity element in a lower concentration than the low resistance regions, for forming an electric resistor for serving as a heat generation region generating heat for image formation between the low resistance regions.

Further preferably, the polycrystalline silicon layer includes a protruding portion with respect to the surface of the substrate, so that the exposed region is formed on this protruding portion. Further, the polycrystalline silicon layer is covered with a protective film, along with the metal electrode layers.

The low resistance regions are provided with a trimmed region, thereby readily adjusting heat generation in the heat generation region.

In a method of manufacturing a thermal print head according to another aspect of the present invention, a polycrystalline silicon layer is formed on a surface of a substrate, an impurity is selectively introduced into this polycrystalline silicon layer thereby forming a low resistance region, a high resistance region having a high sheet resistance is formed on the low resistance region through a mask of the impurity, and a metal electrode layer is formed on a surface of the low resistance region while leaving an exposed region for entirely and partially exposing the high resistance region and the low resistance region respectively.

More preferably, a glaze layer having an arcuate section is formed on the surface of the substrate so that the polycrystalline silicon layer is formed on this glaze layer, and a protective film is formed on the exposed region and the metal electrode layer.

In a heat generation adjusting method according to still another aspect of the present invention, a low resistance region is trimmed for adjusting heat generated from a high resistance region.

According to the present invention, therefore, it is possible to make heating values of respective dots constant for preventing color irregularity, even if the present invention is applied to a high-gradient color printer of 256 gradations, for example.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 9 illustrates patterns connecting an IC and a heat generator part with each other; and FIG. 10 is an enlarged sectional view showing the heat generator part.

DESCRIPTION OF THE PREFERRED EMBODIMENTS

Figure 1:
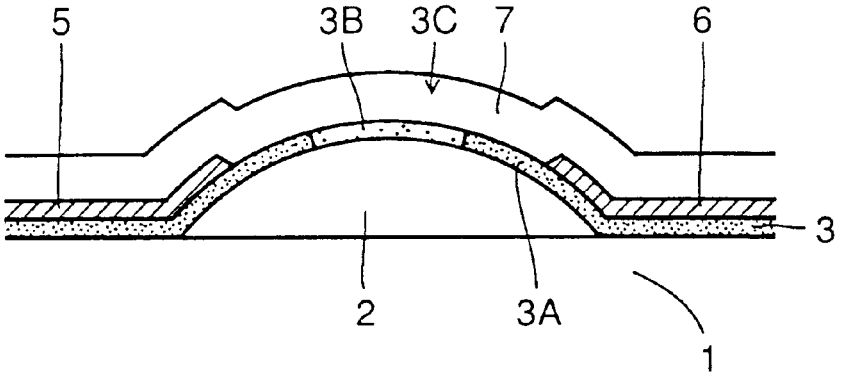
FIG. 1 is a sectional view showing a principal part of a thermal print head according to an embodiment of the present invention.

With reference to FIGS. 1 to 6, a thermal print head according to the present invention is now described in detail.

The inventive thermal print head which is applicable to heat generation adjustment consists of a substrate 1 which is made of ceramic, for example, a glaze layer 2 which is formed on a surface of the substrate 1 in an arcuate sectional contour along longer sides thereof, a plurality of strip-shaped polycrystalline silicon layers 3 which are formed in parallel with each other to extend from a convex surface of the glaze layer 2 toward the surface of the substrate 1, metal electrode layers, i.e., a common electrode 5 and individual electrodes 6 which are formed to be opposed to each other so that the polycrystalline silicon layers 3 are partially exposed on the glaze layer 2, and a protective film 7 which is formed to cover the common and individual electrodes 5 and 6 and surfaces of portions of the polycrystalline silicon layers 3 exposed from these electrodes 5 and 6.

Figure 2:
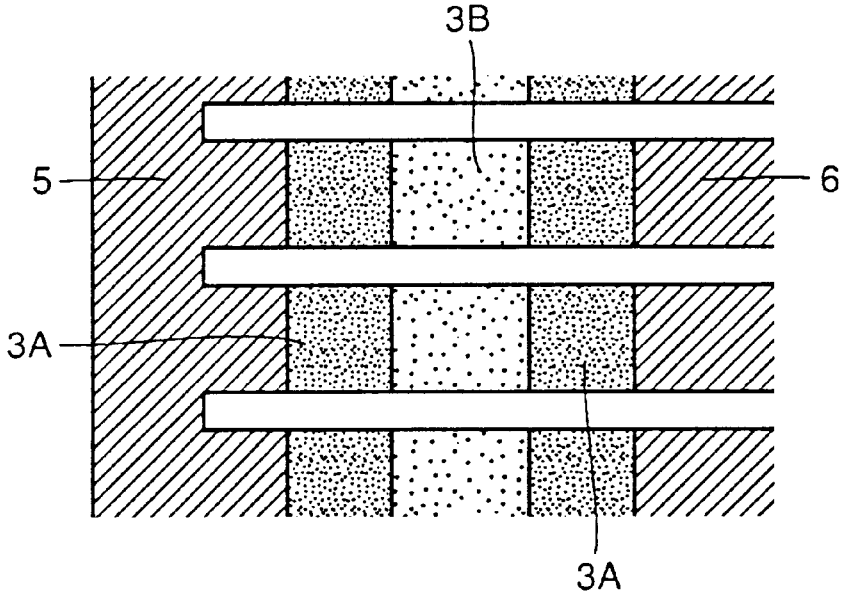
FIG. 2 is a partial plan view showing a principal part of the thermal print head shown in FIG. 1.
Figure 3A:
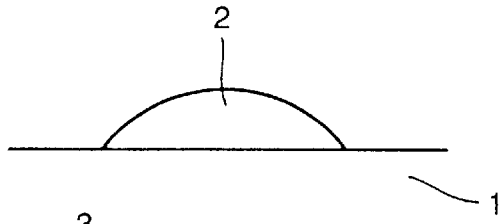
FIGS. 3(*a*) to 3(*e*) illustrate a method of manufacturing the thermal print head according to the present invention.
Figure 3B:
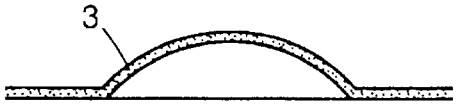
Figure 3C:
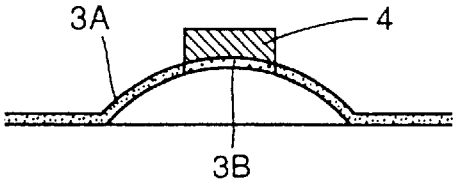
Figure 3D:
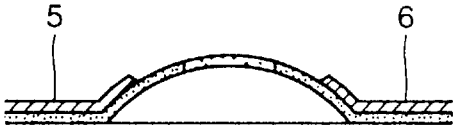
Figure 3E:
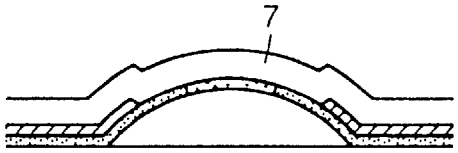

Each polycrystalline silicon layer 3 has an exposed region 3C which is exposed from the common electrode 5 and each individual electrode 6 on its protruding portion. This exposed region 3C consists of low resistance regions 3A extending from under the common and individual electrodes 5 and 6, and a high resistance region 3B, having a higher sheet resistance than the low resistance regions 3A, which is defined between the low resistance regions 3A. The low resistance regions 3A contain an impurity and the common and individual electrodes 5 and 6 are stacked on upper surfaces thereof respectively to be opposed to each other, while the high resistance region 3B contains the impurity in a lower concentration than the low resistance regions 3A for forming an electrical resistor serving as a heat generation dot which generates heat for forming an image between the low resistance regions 3A. As shown in FIG. 2, the low resistance regions 3A, the high resistance regions 3B and the individual regions 6 of the respective dots are separated from each other, while the common electrode 5 is common to all adjacent dots.

The impurity contained in or added to the low and high resistance regions 3A and 3B can be prepared from boron (B) of P-type conductivity which is well known in relation to the semiconductor technique. If boron is employed as the impurity, it is possible to provide each high resistance region 3B with a resistance value of about 1.4 to 6 kΩ/□ by forming this region in an impurity concentration of $10^{17}/cm^3$ when the polycrystalline silicon layer 3 is formed in a thickness of about 0.5 μm, as described later. On the other hand, it is possible to provide each low resistance region 3A with a sheet resistance of about 140 to 600 Ω/□, i.e., about 1/10 that of the high resistance region 3B, by forming this region in an impurity concentration in the range of $3\times10^{18}$ to $2\times10^{19}/cm^3$ after formation of the polycrystalline silicon layer 3.

Due to this structure, the high resistance region 3B is partially formed on the exposed region 3C between the common and individual electrodes 5 and 6 which are opposed to each other, whereby the protective film 7 is not substantially irregularized on its surface portion located on the high resistance region 3B or irregularlized in portions separated from the high resistance region 3B. Thus, a printed medium can be brought into contact with the high resistance region 3B in an excellent state.

The high resistance region 3B is supplied with power through the low resistance regions 3A, doped with the impurity in higher concentrations, which are adjacent to and integrated with the high resistance region 3B.

While the polysilicon layer 3 has a protruding portion on the substrate 1 in the above description, the present invention is also applicable to another type of head having a flat polysilicon layer which is formed on a substrate directly or through a flat glaze layer in place of the convex polysilicon layer 3, as a matter of course.

A method of manufacturing the aforementioned thermal print head is now described with reference to FIGS. 3(*a*) to 3(*e*).

First, a glaze layer 2 having an arcuate sectional contour is formed on a surface of a ceramic substrate 1 to extend in a direction along longer sides of the substrate 1, as shown in FIG. 3(*a*).

Then, a P-type polycrystalline silicon film 3 containing boron as an impurity is stacked/formed on surfaces of the substrate 1 and the glaze layer 2 in a uniform thickness of about 0.5 μm, as shown in FIG. 3(*b*). In this case, the boron concentration is selected in order of $10^{17}cm^3$, thereby providing the polycrystalline silicon film 3 with a sheet resistance of about 1.4 to 6 kΩ/□. Such a P-type polycrystalline silicon film 3 can be formed by low pressure CVD for reacting gases of $SiH_4$ and $B_2H_6$ on the substrate 1 under a temperature condition of about 550 to 750° C.

After formation of the polycrystalline silicon film 3, a resist layer 4 is pattern-formed in a width of about 100 μm on the polycrystalline silicon film 3 which is provided on the glaze layer 2 as shown in FIG. 3(*c*), boron is thereafter ion-implanted into the polycrystalline silicon film 3 as an impurity through a mask of the resist layer 4, and then annealed for forming high-concentration doped regions and a low-concentration doped region defined between these regions. When the impurity concentration by the ion implantation is set in the range of about $3\times10^{16}$ to $2\times10^{19}$ $cm^3$, the high-concentration doped regions are provided with sheet resistances of about 140 to 600 Ω/□.

Then, the resist film 4 is removed and the polycrystalline silicon film 3 is partially etched/removed by photolithography through another patterning mask, thereby pattern-forming a plurality of strip-shaped polycrystalline silicon layers formed by low resistance regions 3A and high resistance regions 3B defined between these regions in parallel with each other. A common electrode 5 is formed to be connected to single ends of the polycrystalline silicon layers in common, while individual electrodes 6 are electrically connected to a driving IC (not shown) in a later step.

Then, the common and individual electrodes 5 and 6 serving as metal electrode layers are pattern-formed by a conductive metal such as aluminum on surfaces of the low resistance regions 3A for exposing the overall high resistance regions 3B and parts of the low resistance regions 3A adjacent thereto, as shown in FIG. 3(*d*).

After such formation of the common and individual electrodes 5 and 6, the driving IC (not shown) is placed on the substrate 1, necessary processing such as wire bonding is performed, and a protective film 7 is formed to cover the metal electrode layers 5 and 6 and exposed regions 3C exposed from these layers 5 and 6, thereby obtaining the inventive thermal print head.

In the thermal print head obtained in the aforementioned manner, the low resistance regions are partially exposed from the common and individual electrodes, whereby heat generation can be readily adjusted in respective heat generation dots.

Figure 4A:
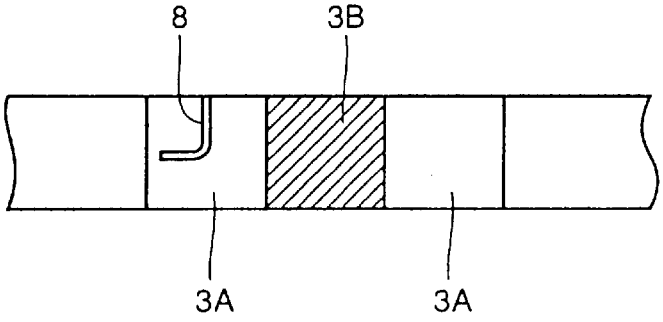
FIGS. 4(*a*) and 4(*b*) are partial plan views showing a trimmed portion in the present invention.
Figure 4B:
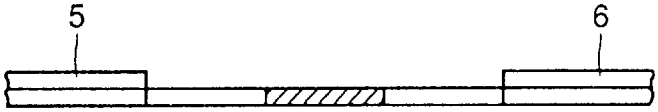

As understood from FIGS. 4(*a*) and 4(*b*) showing typical plan and sectional views of an exposed region 3C respectively, one of the exposed low resistance regions 3A is trimmed at a portion 8 (i.e., a slit 8), whereby heat generation can be so adjusted that power consumption is constant through the respective high resistance regions 3B. While such trimming of the low resistance region 3A may be executed after formation of the common and individual electrodes 5 and 6 and before formation of the protective film 7, the low resistance region 3A can alternatively be trimmed through the protective film 7 after formation thereof. This trimming can be readily executed by irradiating the low resistance region 3A with a laser beam and forming a trimmed groove. FIGS. 4(*a*) and 4(*b*) illustrate the polysilicon layer in a flat manner, in order to simplify the description.

Such heat generation adjustment can be so executed as to conform power consumption by the high resistance regions 3B of the remaining exposed regions 3C to that by the high resistance region 3B of the exposed region 3C exhibiting the maximum resistance value among those in the head. In more concrete terms, the resistance value of each exposed region 3C can be expressed as $R_T=(R_{L1}+R_H+R_{L2})$ assuming that $R_{L1}$, $R_H$ and $R_{L2}$ represent the resistance values of the low resistance region 3A closer to the common electrode 5, the high resistance region 3B and the low resistance region 3A closer to the individual electrode 6 respectively.

Figure 5:
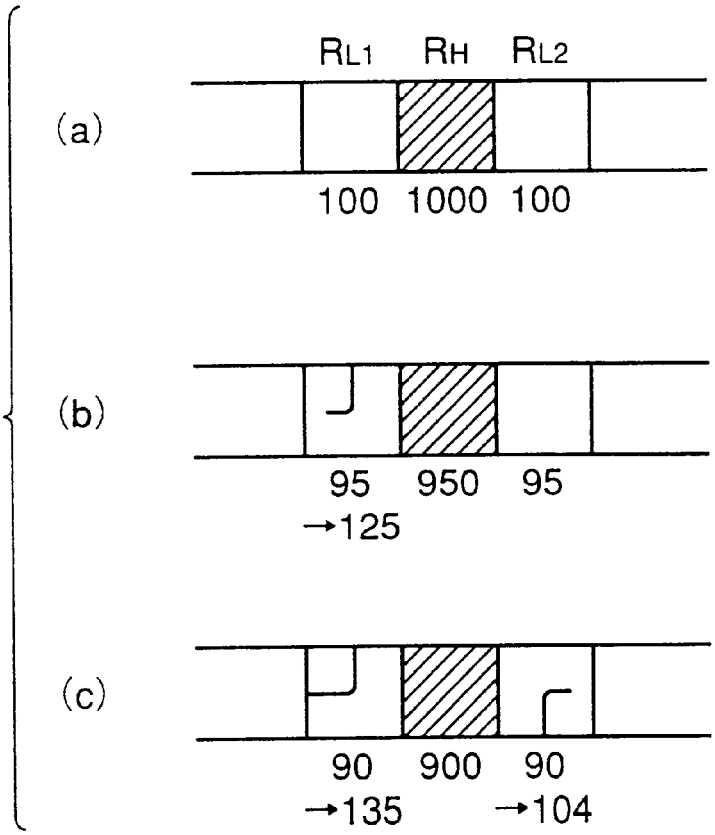
FIGS. 5(*a*) to 5(*c*) are adapted to illustrate a trimming method for the thermal print head according to the present invention.

Assuming that the maximum resistance value $R_{Tmax}$ among the exposed regions of the head is 1200 Ω, the resistance values of the respective regions are $R_{L1}$=100 Ω, $R_H$=1000 Ω and $R_{L2}$=100 Ω respectively as shown in FIG. 5(*a*) and a voltage applied across the metal electrode layers 5 and 6 is 10 V, a current of about 8.333 mA flows in this exposed region 3C, and hence power consumption in the high resistance region 3B is 0.0694 W.

Assuming that the resistance values of an arbitrary exposed region of the head and the respective resistance regions thereof are $R_T$=1140 Ω, $R_{L1}$=95 Ω, $R_H$=950 Ω and $R_{L2}$=95 Ω respectively as shown in FIG. 5(*b*), a current of 8.547 mA may be supplied so that power consumption in the high resistance region of this exposed region is 0.0694 W. This can be executed by increasing the resistance value $R_{L1}$ of one of the low resistance regions closer to the common electrode from 95 Ω to about 125 Ω by laser trimming.

Figure 6:
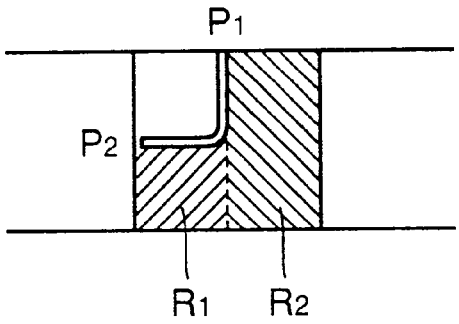
FIG. 6 illustrates a resistance value by the trimming shown in FIG. 5(*b*)
Figure 7:
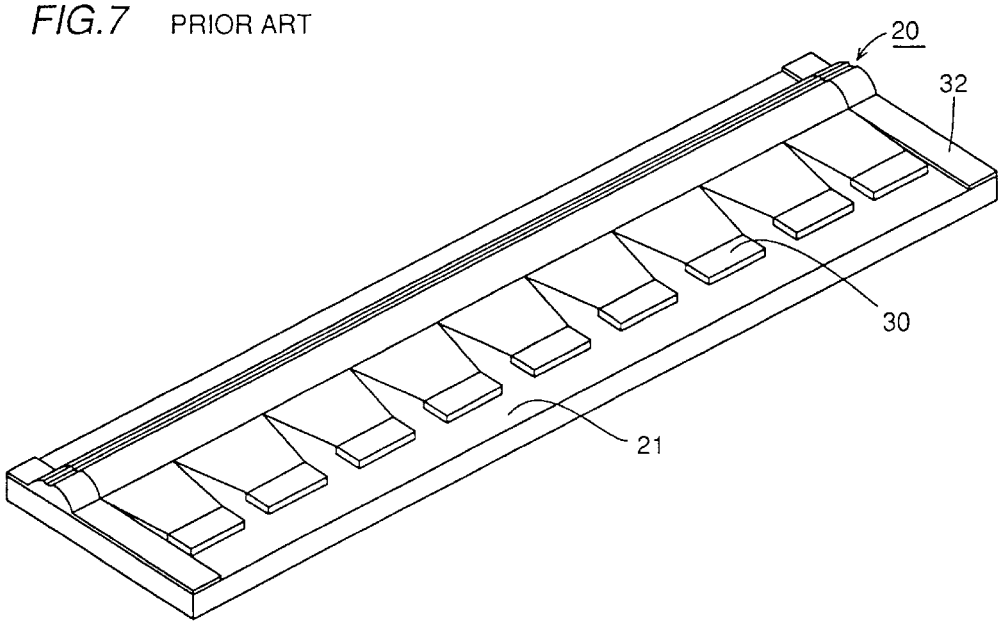
FIG.7 PRIOR ART
FIG. 7 is a perspective view showing the overall appearance of a conventional thin film type thermal print head.
Figure 8:
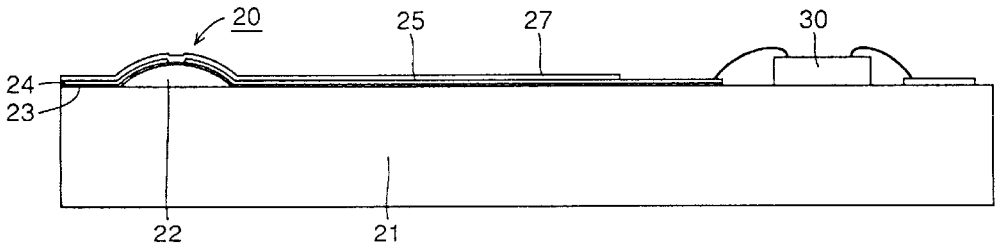
FIG.8 PRIOR ART
FIG. 8 is a sectional view of the thermal print head shown in FIG. 7.

The resistance change of the low resistance region 3A resulting from the aforementioned trimming is now described with reference to FIG. 6. When the low resistance region is trimmed downward from a transverse central portion $P_1$ so that the trimmed portion is bent at the vertical center leftward toward a portion $P_2$, regions $R_1$ and $R_2$ exhibit resistance values of about 95 Ω and about 47.5 Ωrespectively when the overall region between the portions $P_1$ and $P_2$ is trimmed. Therefore, the overall resistance value $R_1+R_2$ is equal to 142.5 Ω, i.e., about 1.5 times the resistance value 95 Ω before the trimming. Thus, the resistance value of each low resistance region can be increased to 1.5 times at the maximum. If the value of the current passing through the high resistance region must be further reduced, the other low resistance region may also be trimmed by a proper resistance value (up to 1.5 times at the maximum).

Assuming that the respective resistance values in another exposed region 3C are $R_I$=1080 Ω, $R_{L1}$=90 Ω, $R_H$=900 Ω and $R_{L2}$=90 Ω respectively as shown in FIG. 5(*c*), on the other hand, a current of about 8.78 mA may be supplied so that power consumption in the high resistance region of this exposed region is 0.0694 W. In this case, however, the resistance value is insufficient if only one of the low resistance regions is trimmed. Therefore, both of the low resistance regions are trimmed in this case so that the resistance values $R_{L1}$ and $R_{L2}$ are increased by 59 Ω in total.

When the remaining exposed regions of the head are also trimmed in the aforementioned manner, it is possible to make the power consumption in the respective high resistance regions constant by forming trimmed grooves in the low resistance regions other than the high resistance regions, i.e., without changing the resistance values of the high resistance regions serving as heat generation dots.

While the low and high resistance regions are formed by polysilicon layers in the above description, the present invention is not restricted to this but is also applicable to a head having low resistance regions which are formed to have sheet resistances of about 1/10 with respect to high resistance regions, for example.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A thermal print head for a thermal printer, said thermal print head being brought into direct contact with a printing medium during printing, said thermal print head comprising:

a substrate;

a polycrystalline silicon layer formed on a surface of said substrate; and metal electrode layer formed on a surface of said polycrystalline silicon layer, said metal electrode layer having a gap, therein forming a pair of metal electrodes opposed to each other through the gap, said polycrystalline silicon layer including an exposed region which is exposed in the gap between said metal electrodes, said exposed region including low resistance regions each extending under one of said metal electrodes, and a high resistance region, having a high sheet resistance, formed between said low resistance regions.

2. The thermal print head in accordance with claim 1, wherein said low resistance regions contain an impurity, said high resistance region containing said impurity in a lower concentration than said low resistance regions, said high resistance region forming an electrical resistor serving as a heat generation region generating heat for forming an image between said low resistance regions.

3. The thermal print head in accordance with claim 1, wherein said polycrystalline silicon layer includes a protruding portion which protrudes with respect to said surface of said substrate, said exposed region being provided on said protruding portion.

4. The thermal print head in accordance with claim 1, further including a protective layer for covering said polycrystalline silicon layer along with said metal electrode layer.

5. The thermal print head in accordance with claim 1, wherein said low resistance regions include a slit region which does not contain the polycrystalline silicon layer.

6. The thermal print head in accordance with claim 1, wherein said polycrystalline silicon layer includes a plurality of said polycrystalline silicon layers and said metal electrode layer includes a plurality of said metal electrode layers, said plurality of polycrystalline silicon layers and metal electrode layers are at predetermined intervals with respect to one another, said opposed metal electrodes formed as a common electrode and an individual electrode.

7. A thermal print head according to claim 1, wherein a width of said low resistance regions and a width of said high resistance region are the same.

8. A thermal print head according to claim 1, wherein said high resistance region is brought into contact with the printing medium.

* * * * *